US009272879B2

(12) United States Patent
Grossrieder et al.

(10) Patent No.: US 9,272,879 B2
(45) Date of Patent: Mar. 1, 2016

(54) ELEVATOR WITH COMPENSATING DEVICE

(75) Inventors: Bernhard Grossrieder, Buochs (CH); Adrian Attinger, Merlischachen (CH); Ernst Ach, Ebikon (CH); Hubert Steiner, Ebikon (CH); Simon Mueller, Lucerne (CH)

(73) Assignee: Inventio AG, Hergiswil (CH)

( * ) Notice: Subject to any disclaimer, the term of this patent is extended or adjusted under 35 U.S.C. 154(b) by 637 days.

(21) Appl. No.: 13/596,467

(22) Filed: Aug. 28, 2012

(65) Prior Publication Data

US 2013/0048431 A1 Feb. 28, 2013

(30) Foreign Application Priority Data

Aug. 31, 2011 (EP) ..... 11179639

(51) Int. Cl.

| | |
|---|---|
| ***B66B 5/02*** | (2006.01) |
| ***B66B 5/12*** | (2006.01) |
| ***B66B 7/06*** | (2006.01) |
| ***B66B 5/00*** | (2006.01) |

(52) U.S. Cl.

CPC ..... *B66B 7/068* (2013.01); *B66B 5/0031* (2013.01); *B66B 5/125* (2013.01); *B66B 5/02* (2013.01)

(58) Field of Classification Search

CPC ..... B66B 7/068; B66B 5/12; B66B 5/125; B66B 5/02; B66B 5/0031; G08B 21/00; G08B 23/00

USPC ..... 187/264, 404, 391, 393

See application file for complete search history.

(56) References Cited

U.S. PATENT DOCUMENTS

| | | | | |
|---|---|---|---|---|
| 2,537,075 | A * | 1/1951 | Margles | 187/264 |
| 5,861,084 | A * | 1/1999 | Barker et al. | 187/264 |
| 6,488,125 | B1 * | 12/2002 | Otsuka et al. | 187/264 |
| 7,117,978 | B2 * | 10/2006 | Kaczmarek et al. | 187/276 |
| 7,147,087 | B2 * | 12/2006 | Tanaka | 187/413 |
| 7,610,994 | B2 * | 11/2009 | Green | 187/251 |
| 7,784,590 | B2 * | 8/2010 | Watanabe | B66B 5/021 187/388 |

FOREIGN PATENT DOCUMENTS

| | | | | |
|---|---|---|---|---|
| DE | 1225356 | B * | 9/1966 | B66B 5/12 |
| EP | 1123891 | A2 * | 8/2001 | B66B 7/06 |
| EP | 2537791 | A1 * | 12/2012 | B66B 7/06 |
| GB | 786410 | A * | 11/1957 | B66B 7/06 |
| JP | 64-21180 | U | 2/1989 | |
| JP | 11-209030 | A | 8/1999 | |
| JP | WO 2012117479 | A1 * | 9/2012 | B66B 5/0031 |

* cited by examiner

*Primary Examiner* — William A Rivera
*Assistant Examiner* — Stefan Kruer
(74) *Attorney, Agent, or Firm* — Fraser Clemens Martin & Miller LLC; William J. Clemens

(57) ABSTRACT

A compensating means is guided between an elevator cage and a counterweight on the counterweight side by a guide device and monitored by a monitoring device.

7 Claims, 5 Drawing Sheets

ELEVATOR WITH COMPENSATING DEVICE

CROSS-REFERENCE TO RELATED APPLICATION

This application claims priority to European Patent Application No. 11179639.7, filed Aug. 31, 2011, which is incorporated herein by reference.

FIELD

The disclosure relates to an elevator.

BACKGROUND

In elevators with large conveying heights a device for providing compensation for the weight of a suspension means is usually provided. The suspension means is guided over a drive pulley which in turn is drivable by means of an elevator drive. An elevator cage is arranged at one end of the suspension means and a counterweight is arranged at the other end of the suspension means. The elevator cage and the counterweight are movable by way of the suspension means in opposite directions in an elevator shaft, wherein the elevator cage serves stories.

If the elevator cage is disposed at the top in the elevator shaft, the suspension means length and the weight of the suspension means on the counterweight side is large. If the elevator cage is disposed at the bottom of the elevator shaft, the suspension means length and the weight of the suspension means on the cage side is large. Provided as compensation for the weight displacement from the counterweight side to the cage side and conversely is a compensating means which is arranged at one end underneath at the elevator cage and at the other end underneath at the counterweight. If, for example, the suspension means length is large on the counterweight side the compensating means length is small on the counterweight side and large on the cage side. Balancing of or compensation for the weight displacement on the part of the suspension means is provided by the compensating means acting in opposite directions. Drive torque, braking moment and traction at the drive pulley can be optimized by the weight compensation.

However, the compensating means hanging at the elevator cage and at the counterweight is susceptible to oscillation, including in the case of elevator installations with large conveying heights, or through other influences such as, for example, air in the elevator shaft, earthquakes or building fluctuations. In the case of movement of the elevator cage and the counterweight the compensating means, for example an encased chain, can be excited into oscillation, wherein the deflection of the compensating means in the case of further travel of the elevator cage and the counterweight can be amplified. The deflection can be of such a magnitude that the compensating means whips against the shaft walls. In that case there is the risk that the compensating means can tangle with shaft fittings, for example fastening brackets for guide rails. If the compensating means is tangled on the counterweight side and the elevator cage moves upwardly and the counterweight downwardly then the compensating means can be additionally tensioned from the damage point to the elevator cage and can be loose from the damage point to the counterweight. Such damage can be dangerous for safe operation of the elevator installation. In the extreme case the compensating means can break and cause consequential damage.

SUMMARY

In at least some embodiments, at least one compensating means is arranged between an elevator cage and a counterweight and serves for compensation for the weight of a suspension means, wherein the compensating means is guided by means of a guide device and forms a linear part, a loop part and a curved part and wherein the loop part and the curved part together have a form similar to a parabola. At least some embodiments create a monitoring which can be tolerant relative to deflections of a compensating means, but which can help guarantee safety of the elevator installation.

At least some embodiments allow that the compensating means can be simply and reliably monitored. For example, loop movements triggered by oscillations in the compensating means switch off the elevator installation only when the loop movements adopt, for the compensating means and for the shaft fittings, a potential with destructive force. After switching-off of the elevator installation the elevator cage and counterweight can run on due to inertia. The proposed device takes into consideration this running-on without damage being caused directly after the switching off.

Under normal conditions, for example in the case of building fluctuations or in the case of draft air in the elevator shaft or in the case of inspection travel or in the case of emergency stopping situations or in the case of mere contact of the shaft walls or of the shaft floor, switching off need not take place. The proposed device can be settable in this respect to the respective elevator installation.

The proposed device can be suitable for a compensating means with a linear part, possibly on the counterweight side, and a curved part, possibly on the cage side. A guide device arranged, for example, below the travel path of the counterweight and centrally with respect to the counterweight guide rails guides and damps the compensating means, possibly on the counterweight side. Between the guide device and the elevator cage the compensating means adopts a form similar to a parabola with a loop part and a slightly curved part. If the compensating means tangles on, for example, the counterweight side while the elevator cage travels upwardly the loop part progressively reduces and moves ever closer to the guide device. A comparable state can also occur in the case of strong oscillations in the compensating means. Without switching-off of the elevator installation in good time at least the guide device would be damaged.

BRIEF DESCRIPTION OF THE DRAWINGS

The proposed device is explained in more detail on the basis of embodiments by way of the accompanying figures, in which.

DETAILED DESCRIPTION

Figure 1:
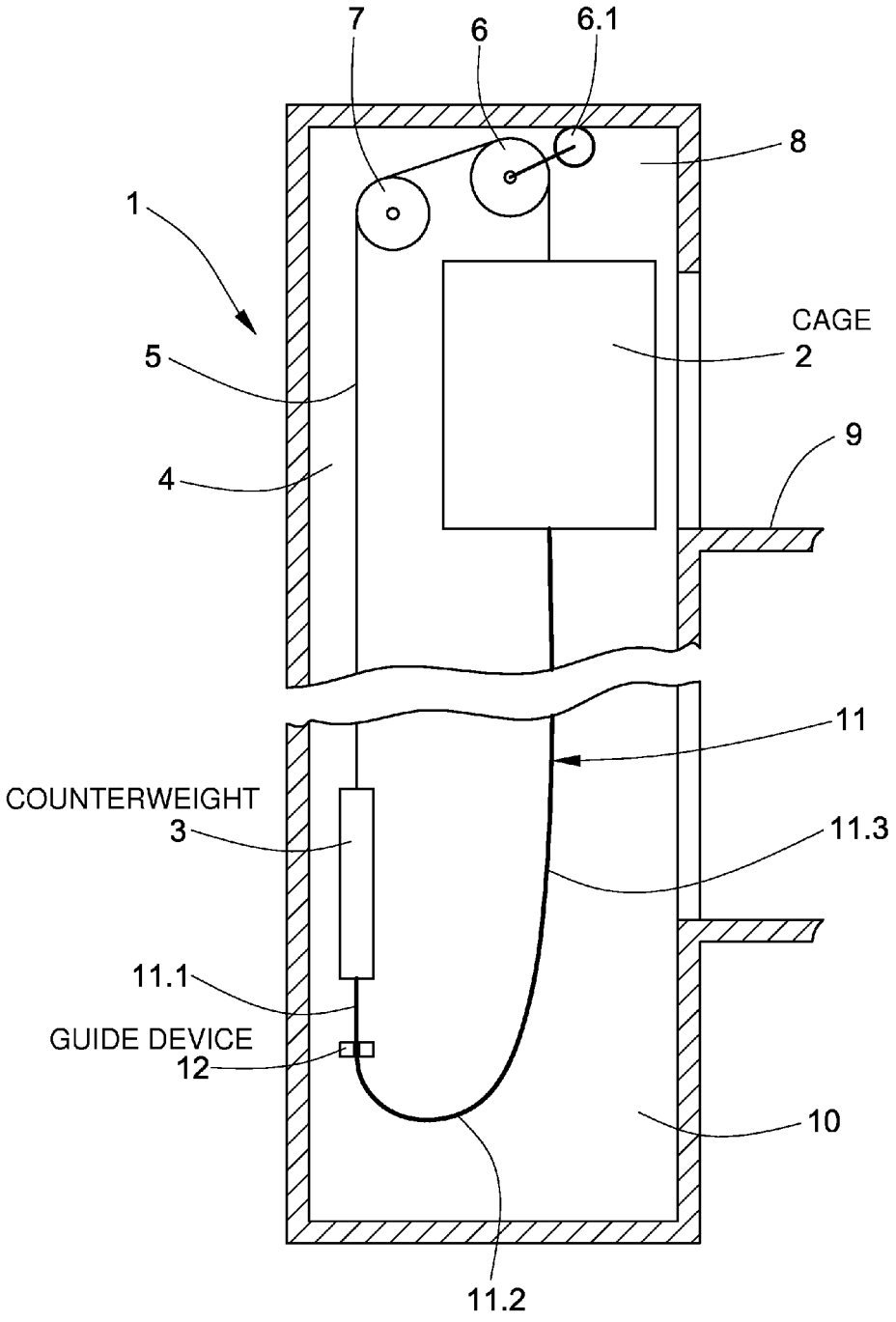
FIG. 1 shows an exemplifying elevator installation with an elevator cage, a counterweight and compensating means.

FIG. 1 shows an elevator installation 1 with an elevator cage 2 which is movable in an elevator shaft 4 in opposite direction to a counterweight 3. The elevator cage 2 is connected with the counterweight 3 by way of a suspension means 5, which can be for example a rope a belt or a chain. The suspension means 5 is guided over a drive pulley 6 and a deflecting roller 7, wherein the drive pulley 6 is part of a drive 6.1 arranged in an engine room 8. An elevator installation 1 without engine room 8, in which the drive is arranged in the elevator shaft 4, is also possible.

In the embodiment a 1:1 suspension means guidance is shown. Other forms of suspension means guidance are also possible. The elevator cage 2 stands at an uppermost story 9, whilst the counterweight 3 stands above a shaft pit 10. In this position of the elevator cage 2 and the counterweight 3 the suspension means 5 is short on the cage side and long on the counterweight side. Serving as weight compensation for the different suspension means lengths is a compensating means, which is denoted by 11, between elevator cage 2 and counterweight 1. In the illustrated embodiment the compensating means 11 provides compensation for the absent weight of the suspension means 5 on the cage side. The compensating means 11 can be for example a rope a belt or a chain.

A guide device 12, which guides the compensating means 11 particularly on the counterweight side and damps it in terms of oscillation, is provided below the travel path of the counterweight 3 and centrally between the counterweight guide rails. The compensating means 11 forms itself linearly or has a linear part 11.1 between the counterweight 3 and the guide device 12. Between the guide device 12 and the elevator cage 2 the compensating means 11 adopts a form, which is similar to a parabola, with a loop part 11.2 and a slightly curved part 11.3.

Figure 2:
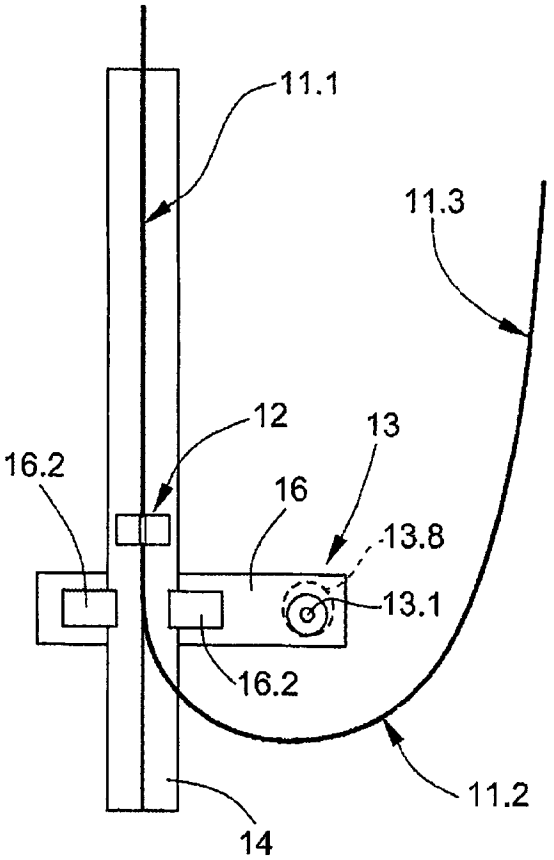
FIG. 2 shows a side view of an exemplifying guide device and a monitoring device for the compensating means in normal operation.

FIG. 2 shows a side view of the guide device 12 and a monitoring device 13 with a detection region 13.8 for the compensating means 11 in normal operation. The detection region 13.8 is so selected that tolerances of the device and of the mounting and constructional differences are taken into consideration. On the counterweight side the compensating means 11 is guided by means of the guide device 12, for example by means of a roller guide. The course of the compensating means 11 is, as explained further above, linear from the counterweight 3 to the guide device 12 and parabolic from the guide device 12 to the elevator cage 2. A respective bracket 16, 17 for the monitoring device 13 is arranged at each of a first guide rail 14 and a second guide rail 15.

Figure 3:
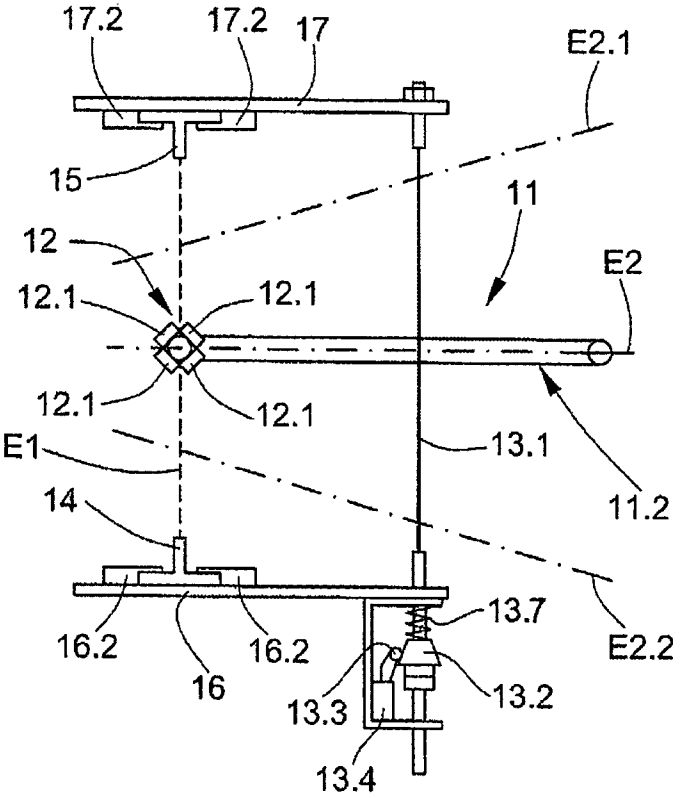
FIG. 3 shows a plan view of the guide device and the monitoring device for the compensating means in normal operation.

FIG. 3 shows a plan view of the guide device 12 and of the monitoring device 13 for the compensating means 11 in normal operation. From the counterweight 3 to the guide device 12 the compensating means runs in a first plane E1 spanned by the guide rails 14, 15 of the counterweight 3. The guide device 12 consists of, for example, four rollers 12.1 enclosing the compensating means 11. A line 13.1, which penetrates approximately at right angles a second plane E2 spanned by the compensating means 11 and is arranged above the loop part 11.2, stretches from the bracket 16 to the bracket 17. The line 13.1 is, for example, made in cable-like manner from synthetic fibers and is flexible. The line 13.1 can also pass through the second plane E2 at an inclination if the counterweight 3 is arranged eccentrically or in a shaft corner. Further planes E2.1 and E2.2 are shown in FIG. 3, which are each spanned by a respective compensating means for the case that two compensating means 11 are provided between the elevator cage 2 and the counterweight 3. The line 13.1 similarly passes through the second planes E2.1, E2.2 at an inclination and can be actuated by one or both compensating means 11 simultaneously. The line 13.1 is fixed to the second bracket 17 and resiliently mounted on the first bracket 16 in the line longitudinal axis, wherein in the case of deflection of the line 13.1 caused by the loop part 11.2 a cam 13.2 is moved into the line longitudinal axis. A finger 13.3 of an electrical switch 13.4, which switches off the elevator drive 6.1, is actuated by the moved cam 13.2.

Figure 5:
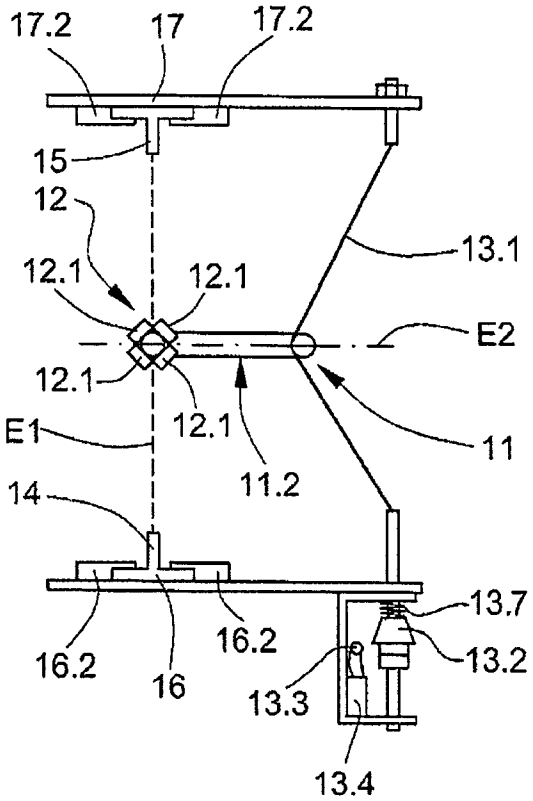
FIG. 5 shows a plan view of the guide device and the monitoring device for the compensating means in the case of disturbance.
Figure 4:
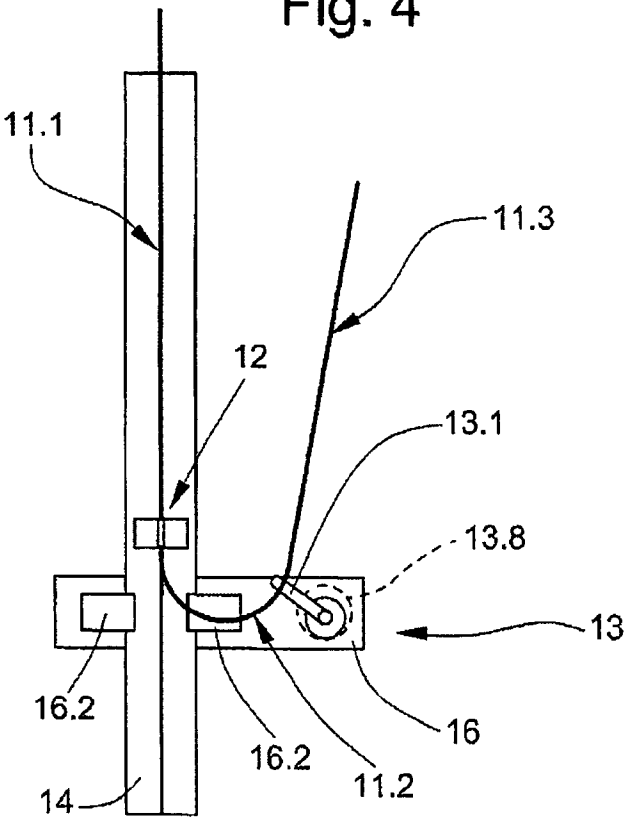
FIG. 4 shows a side view of the guide device and the monitoring device for the compensating means in the case of disturbance.

FIG. 4 shows a side view and FIG. 5 shows a plan view of the guide device 12 and the monitoring device 13 for the compensating means 11 in the case of a disturbance. A disturbance situation occurs if, for example, the compensating means 11 tangles on the counterweight side when the elevator cage travels upwardly or if, for example, an extreme deflection in the compensating means 11 reduces the loop part 11.2 to such an extent that the compensating means 11 moves into the detection region 13.8 of the monitoring device 13, in which case the line 13.1 actuates the switch 13.4. As soon as the line 13.1 is deflected by the loop part 11.2, at least one fault signal is generated and, for example, the elevator drive 6.1 switched off. Even if the drive brake engages immediately, running-on of the elevator cage or of the counterweight may be unavoidable. Nevertheless, none of the guide device 12, the line 13.1 and the compensating means 11 is damaged, because the switching off takes place in good time and the loop part 11.2 in practice generally is not smaller than shown in FIG. 4.

Figure 6:
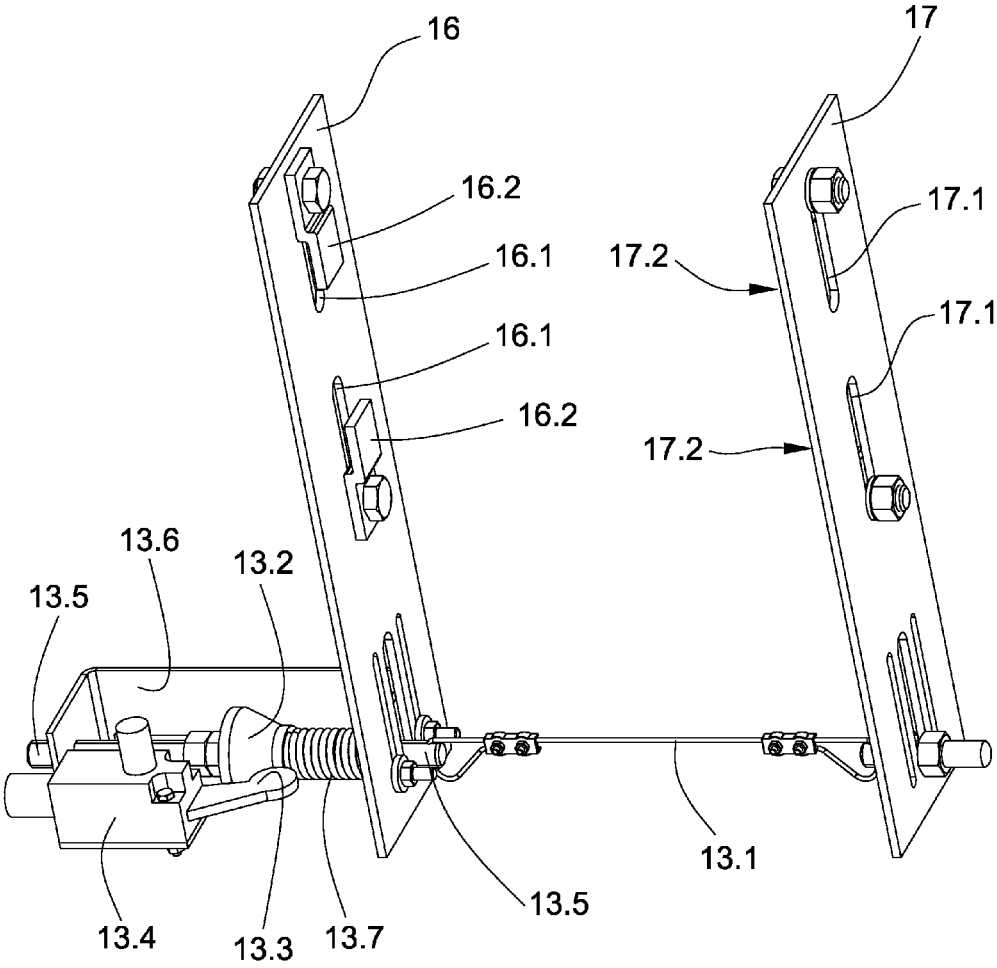
FIG. 6 shows a constructional design of the monitoring device.

FIG. 6 shows a constructional embodiment of the monitoring device 13. The brackets 16, 17 are provided with slots 16.1, 17.1, at which claws 16.2, 17.2 are displaceably mounted. The first bracket 16 is disposed below the first guide rail 14 and detachably connected by means of the claws 16.2 with the guide rail 14. The second bracket 17 is disposed below the second guide rail 15 and detachably connected with the guide rail 15 by means of the claws 17.2. The end of the line 13.1 remote from the switch is settably, but fixedly connected with the second bracket 17. The end of the line 13.1 near the switch is connected with a first axle 13.5 displaceable in the line longitudinal axis, which axle is mounted at one end on the first bracket 16 and at the other end on the bracket 13.6. The first axle 13.5 is displaceable by the line 13.1 against a spring force of a spring 13.7 and also the cam 13.2 is moved by the first axle 13.5. The position of the cam 13.2 is detected by means of the finger 13.3, which actuates the switch 13.4 in the case of deflection of the line 13.1.

Instead of the line 13.1 it is also possible to provide a yoke or a barrier which is actuable by means of the loop part 11.2. The yoke or the barrier is flexibly mounted so that the loop part 11.2 cannot cause damage in the case of a running on.

Figure 7:
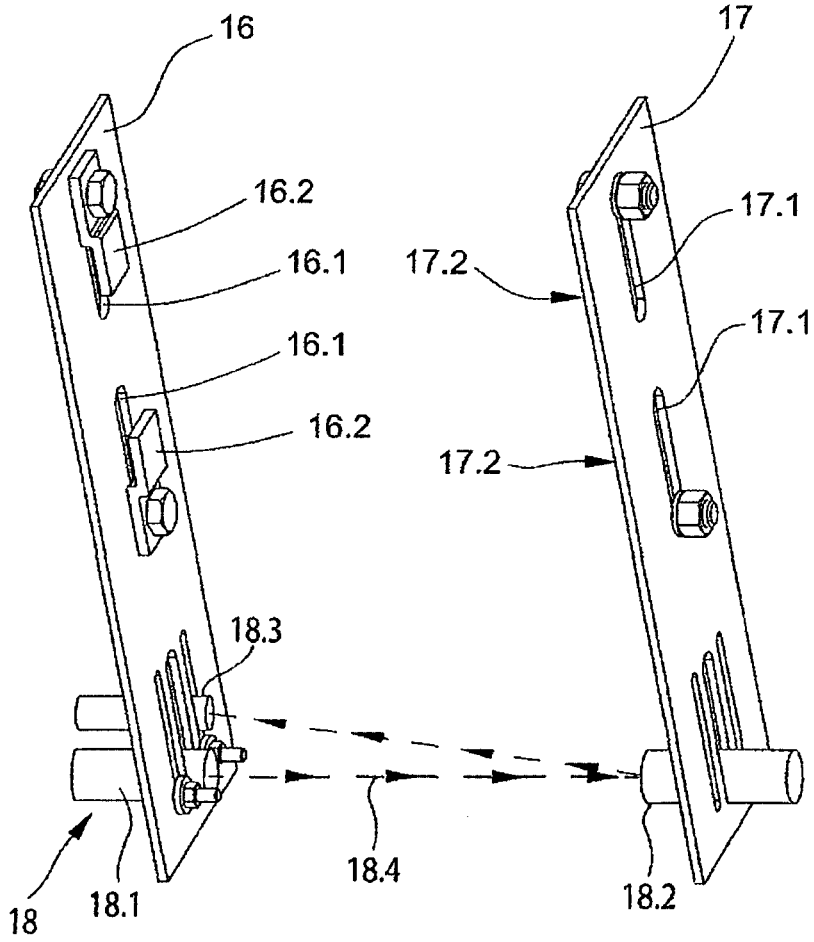
FIG. 7 shows a constructional design of another embodiment of the monitoring device.

Instead of the line 13.1 and the switch 13.4 it is also possible to provide, for example, an optoelectronic monitoring device 18 which consists of a transmitter 18.1, a reflector 18.2 and a receiver 18.3, as depicted in FIG. 7. The transmitter 18.1 arranged at the first bracket 16 transmits a light beam 18.4, for example in the infrared region, to a reflector 18.2, which is arranged at the second bracket 17 and which reflects the light beam 18.4 to the receiver 18.3 arranged at the first bracket 16. If the compensating means 11 enters the detection region 13.8 of the monitoring device 13 the loop part 11.2 interrupts the light beam 18.4 and the receiver 18.3 generates a signal for switching off the elevator drive 6.1 and for activation of the brake. Transmitter 18.1 reflector 18.2 and receiver 18.3 are so arranged that the light beam 18.4 is interrupted in good time and generally no damage of shaft fittings and/or compensating means can occur even in the case of running-on of the elevator cage and the counterweight. The optoelectronic monitoring device 18 or sensor can also consist only of a transmitter 18.1 and a receiver 18.3 in which case the transmitter 18.1 is arranged at, for example, the first bracket 16 and the receiver 18.3 at the second bracket 17.

The guide device 12 and the monitoring device 13 can, as an alternative, also be arranged on the cage side.

Having illustrated and described the principles of the disclosed technologies, it will be apparent to those skilled in the art that the disclosed embodiments can be modified in arrangement and detail without departing from such principles. In view of the many possible embodiments to which the principles of the disclosed technologies can be applied, it should be recognized that the illustrated embodiments are only examples of the technologies and should not be taken as limiting the scope of the invention. Rather, the scope of the invention is defined by the following claims and their equivalents. We therefore claim as our invention all that comes within the scope and spirit of these claims.

We claim:

1. An elevator comprising:

an elevator cage disposed in a shaft;

a counterweight disposed in the shaft;

a suspension device coupled to the elevator cage and the counterweight;

a compensation device for the suspension device, the compensation device being coupled to the elevator cage and the counterweight;

a guide device for the compensation device, the guide device causing the compensation device to form a linear part, a loop part and a curved part, the loop part and curved part together having a parabolic form;

a monitoring device at the guide device, the monitoring device having a detection region, the monitoring device being triggered by the loop part of the compensation device being in the detection region;

the monitoring device comprising a sensor, the sensor comprising a line resiliently mounted between a first bracket and a second bracket to form a longitudinal axis, the line passing through a plane spanned by the loop part; and a cam being configured to move along the longitudinal axis in case of deflection of the line by the loop part.

2. The elevator of claim 1, the monitoring device being coupled to an elevator drive, the monitoring device being configured to generate, upon being triggered, a fault signal for switching off the elevator drive.

3. The elevator of claim 1, the sensor acting at approximately right angles or at an inclination to the plane.

4. The elevator of claim 1, further comprising an electrical switch that turns off an elevator drive upon detecting movement of the cam.

5. An elevator comprising:

an elevator cage disposed in a shaft;

a counterweight disposed in the shaft;

a suspension device coupled to the elevator cage and the counterweight;

a compensation device for the suspension device, the compensation device being coupled to the elevator cage and the counterweight;

a guide device for the compensation device, the guide device causing the compensation device to form a linear part, a loop part and a curved part, the loop part and curved part together having a parabolic form;

a monitoring device at the guide device, the monitoring device having a detection region, the monitoring device being triggered by the loop part of the compensation device being in the detection region;

the monitoring device comprising a sensor, the sensor comprising a light beam that passes through the plane spanned by the loop part, the sensor being configured to turn off an elevator drive when the light beam is interrupted, the light beam corresponding to the detection region.

6. An elevator method, comprising:

monitoring a detection region of a monitoring device arranged in an elevator shaft, an elevator cage and a counterweight also being arranged in the elevator shaft, a suspension device being coupled to the elevator cage and the counterweight, a compensation device for the suspension device being coupled to the elevator cage and the counterweight, the compensation device being guided by a guide device forming a linear part, a loop part and a curved part, the loop part and the curved part together having a parabolic form, the monitoring device being arranged near the guide device, the monitoring device comprising a sensor, the sensor comprising a line resiliently mounted between a first bracket and a second bracket to form a longitudinal axis, the line passing through a plane spanned by the loop part, and a cam being configured to move along the longitudinal axis in case of deflection of the line by the loop part, the monitoring device being triggered by the loop part of the compensation device being in the detection region;

generating a fault signal upon detecting that the loop part of the compensating device has entered the detection region of the monitoring device.

7. The method of claim 6, further comprising:

switching off an elevator drive based on the fault signal; and engaging a drive brake on the fault signal.

* * * * *